US008611770B2

(12) United States Patent
Mizutani et al.

(10) Patent No.: US 8,611,770 B2
(45) Date of Patent: Dec. 17, 2013

(54) IMAGE FORMING APPARATUS

(75) Inventors: Naoki Mizutani, Osaka (JP); Naoki Yamane, Osaka (JP); Kazuya Yamashita, Osaka (JP); Kohshiroh Tomimori, Osaka (JP)

(73) Assignee: Kyocera Document Solutions Inc. (JP)

( * ) Notice: Subject to any disclaimer, the term of this patent is extended or adjusted under 35 U.S.C. 154(b) by 195 days.

(21) Appl. No.: 13/180,661

(22) Filed: Jul. 12, 2011

(65) Prior Publication Data

US 2012/0027438 A1 Feb. 2, 2012

(30) Foreign Application Priority Data

Jul. 30, 2010 (JP) ..... P2010-172217

(51) Int. Cl.
*G03G 21/12* (2006.01)

(52) U.S. Cl.
USPC ..... 399/35; 399/256; 399/360

(58) Field of Classification Search
USPC ..... 399/35, 256, 360
See application file for complete search history.

(56) References Cited

U.S. PATENT DOCUMENTS

| | | | | |
|---|---|---|---|---|
| 7,991,344 | B2 * | 8/2011 | Naruse | 399/358 |
| 2011/0020038 | A1 * | 1/2011 | Hatakeyama et al. | 399/256 |

FOREIGN PATENT DOCUMENTS

| | | |
|---|---|---|
| JP | 03-059693 | 3/1991 |
| JP | 11-038850 | 2/1999 |
| JP | 11-167327 | 6/1999 |
| JP | 11-258963 | 9/1999 |

* cited by examiner

*Primary Examiner* — David Gray
*Assistant Examiner* — Michael Harrison
(74) *Attorney, Agent, or Firm* — Ostrolenk Faber

(57) ABSTRACT

An image forming apparatus includes: a storage container which horizontally stores a waste toner; a full detection sensor which detects whether the waste toner reaches a full position; a near detection sensor which detects whether the waste toner reaches a near position; and a conveyance portion which is provided inside the storage container, includes an axial rod, and rotates about the axial rod, wherein the conveyance portion includes: a first spiral protrusion which conveys the waste toner to the near position; a second spiral protrusion which conveys the waste toner from the near position to the full position; and a third range which is provided between the first spiral protrusion and the second spiral protrusion and through which the waste toner passes at a speed lower than the conveyance speed of the first spiral protrusion and the second spiral protrusion.

4 Claims, 6 Drawing Sheets

IMAGE FORMING APPARATUS

BACKGROUND OF THE INVENTION

1. Field of the Invention

Priority is claimed on Japanese Patent Application No. 2010-172217, filed Jul. 30, 2010, the content of which is incorporated herein by reference.

The present invention relates to an image forming apparatus.

2. Description of Related Art

In electro-photographic image forming apparatuses such as copying machines or printers according to the related art, residual toner adhered to a photosensitive drum, an intermediate transfer belt, or the like is cleaned by a cleaner and is collected into a dedicated waste toner container. When the waste toner container is fully filled with the waste toner, the waste toner container is replaced. The waste toner container has a near detection sensor and a full detection sensor attached thereto, where the near detection sensor is configured to detect that the waste toner container is nearly fully filled with the waste toner and the full detection sensor is configured to detect that the waste toner container is fully filled with the waste toner. When the near detection sensor detects that the waste toner container is nearly fully filled with the waste toner, a user is urged to replace the waste toner container via a notification unit such as a touch panel. Further, when the full detection sensor detects that the waste toner container is fully filled with the waste toner, the image forming operation is stopped. The waste toner collection device as described above is disclosed, which gradually detects the amount of the waste toner collected by the waste toner container by using a plurality of sensors.

Hereinafter, the position where the near detection sensor is to be attached is referred to as the near position, and the state in which the waste toner container is nearly fully filled with the waste toner and which is detected by the near detection sensor is referred to as near detection. Further, the position where the full detection sensor is to be attached is referred to as the full position, and the state in which the waste toner container is fully filled with the waste toner and which is detected by the full detection sensor is referred to as full detection.

In the related art, when the distance between the near position and the full position is close, there is a possibility of erroneous detection in which full detection occurs immediately after near detection or in which full detection occurs before near detection. Therefore, the image forming operation may be stopped immediately after the request of the replacement of the waste toner container or the image forming operation may be stopped without the request of the replacement of the waste toner container.

SUMMARY OF THE INVENTION

According to an aspect of the invention, there is provided an image forming apparatus including: a storage container which horizontally stores waste toner received from a storage port; a full detection sensor which detects whether the waste toner reaches a full position that is the end at the opposite side of the storage port inside the storage container; a near detection sensor which detects whether the waste toner reaches a near position closer to the storage port than the full position; and a conveyance portion which is provided inside the storage container, includes an axial rod, and rotates about the axial rod, wherein the conveyance portion includes: a first spiral protrusion which conveys the waste toner to the near position;

a second spiral protrusion which conveys the waste toner from the near position to the full position; and a third range which is provided between the first spiral protrusion and the second spiral protrusion and through which the waste toner passes at a speed lower than the conveyance speed of the first spiral protrusion and the second spiral protrusion.

According to the image forming apparatus as described above, since the speed of conveying the waste toner in the third range is lower than the speeds of conveyance of the first spiral protrusion and the second spiral protrusion, it takes a certain amount of time for the waste toner to move to the position of the full detection sensor after it moves to the position of the near detection sensor. For this reason, it is possible to prevent erroneous detection in which full detection occurs immediately after near detection or in which full detection occurs before near detection.

DETAILED DESCRIPTION OF THE INVENTION

An object of the invention is to prevent erroneous detection in which full detection occurs immediately after near detection or full detection occurs before near detection.

Hereinafter, an exemplary embodiment of the invention will be described by referring to the accompanying drawings.

Figure 1:
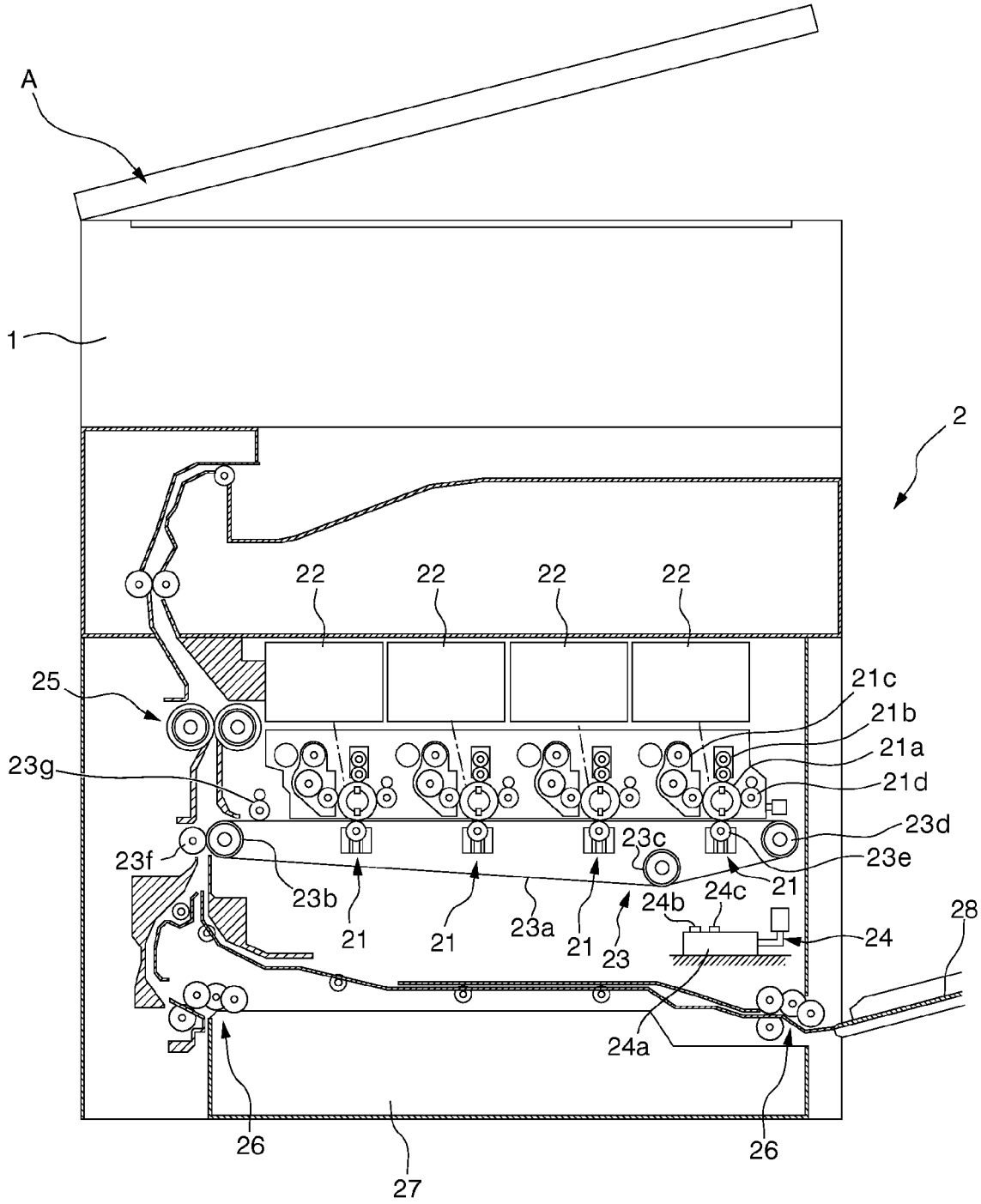
FIG. 1 is a cross-sectional view illustrating a schematic configuration of a multifunctional machine A according to an embodiment of the invention.

A multifunctional machine (an image forming apparatus) A according to the embodiment is configured to perform copying, printing, and the like in an electro-photographic method. As shown in FIG. 1, the multifunctional machine A includes an image reading device 1 which reads an image of a document, and an image forming device 2 which forms an image on a recording sheet on the basis of image data.

The image reading device 1 reads an image (a document image) of a document placed on a platen glass through a liner sensor and outputs the read image by converting it into document image data.

The image forming device 2 forms an image on a recording sheet conveyed from a sheet feeding cassette 27 or a sheet feeding tray 28 (refer to FIG. 1) on the basis of the image data. As shown in FIG. 1, the image forming device 2 includes a plurality of image forming units 21, a laser scanning unit 22, an intermediate transfer unit 23, a waste toner container 24, a fixing unit 25, a sheet feeding roller 26, a sheet feeding cassette 27, and a sheet feeding tray 28.

The image forming units 21 respectively form an image by using toners of respective colors of yellow (Y), magenta (M), cyan (C), and black (BK). Each of the plurality of image forming units 21 is disposed at a predetermined interval in the horizontal direction when seen from the front side of the multifunctional machine A. As shown in FIG. 1, each image forming unit 21 includes a photosensitive drum 21*a*, a charger 21*b*, a developing unit 21*c*, and a cleaner 21*d*.

The photosensitive drum 21*a* is a cylindrical component which forms an electrostatic latent image and a toner image based on the electrostatic latent image on the circumferential surface thereof. The photosensitive drum 21*a* is disposed to extend in the depth direction when seen from the front side of the multifunctional machine A. A driving unit (not shown) is independently provided at each photosensitive drum 21*a* so as to adjust the speed thereof. By adopting the driving unit, the photosensitive drum 21*a* rotates in the circumferential direction during an image forming process.

The charger 21*b* is disposed to face the photosensitive drum 21*a* and charges the circumferential surface of the photosensitive drum 21*a*.

The developing unit 21*c* supplies toner to the circumferential surface of the photosensitive drum 21*a*. Consequently, a toner image based on the electrostatic latent image is formed (is developed) on the circumferential surface of the photosensitive drum 21*a*.

The cleaner 21*d* removes toner remaining on the photosensitive drum 21*a* after the toner image is transferred from the photosensitive drum 21*a* to an intermediate transfer unit 23 (specifically, an intermediate transfer belt 23*a*) to be described later. The cleaner 21*d* includes a cleaning roller, a cleaning blade, or the like.

The laser scanning unit 22 is disposed above each image forming unit 21. The laser scanning unit 22 scans the circumferential surface of each charged photosensitive drum 21*a* through a laser beam so as to form an electrostatic latent image corresponding to each color thereon.

The intermediate transfer unit 23 is disposed below the plurality of image forming units 21. The intermediate transfer unit 23 includes the intermediate transfer belt 23*a*, a driving roller 23*b*, a tension roller 23*c*, a driven roller 23*d*, a primary transfer roller 23*e*, a secondary transfer roller 23*f*, and a cleaning portion 23*g*.

The intermediate transfer belt 23*a* is a recording medium to which a toner image is firstly transferred from the plurality of image forming units 21, and is suspended on the driving roller 23*b*, the tension roller 23*c*, and the driven roller 23*d*.

The driving roller 23*b* is connected to a driving unit having a driving source such as a motor, and moves the intermediate transfer belt 23*a* in a circulating manner.

The tension roller 23*c* is a type of a driven roller that rotates to follow the rotation of the driving roller 23*b*, and includes a spring mechanism that applies a tension to the intermediate transfer belt 23*a*.

The driven roller 23*d* rotates with the rotation of the intermediate transfer belt 23*a*.

The primary transfer roller 23*e* is disposed to face the photosensitive drum 21*a* with the intermediate transfer belt 23*a* interposed therebetween, and releases a transfer current to the intermediate transfer belt 23*a*. Therefore, the toner image on each photosensitive drum 21*a* is firstly transferred to the intermediate transfer belt 23*a*.

The secondary transfer roller 23*f* secondly transfers the toner image on the intermediate transfer belt 23*a* to the recording sheet.

The cleaning portion 23*g* is provided at the downstream side of the driving roller 23*b* in the rotation direction of the intermediate transfer belt 23*a* and is provided at the upstream side of the first image forming unit 21. The cleaning portion 23*g* includes a cleaning blade that contacts the surface of the intermediate transfer belt 23*a*, and removes toner (waste toner) remaining on the intermediate transfer belt 23*a*. The waste toner removed by the cleaning portion 23*g* is transferred to the waste toner container 24 via a conveyance mechanism (not shown) including a spiral screw and the like.

Furthermore, in the example shown in the drawing, nothing is shown at the opposite side of the cleaning portion 23*g* with the intermediate transfer belt 23*a* interposed therebetween, however this is only for simplification of the drawing. In the actual apparatus, in order to efficiently remove the waste toner, there are provided a simple roller or plural rollers which are able to press the intermediate transfer belt 23*a* against the cleaning portion 23*g* during cleaning.

Figure 2:
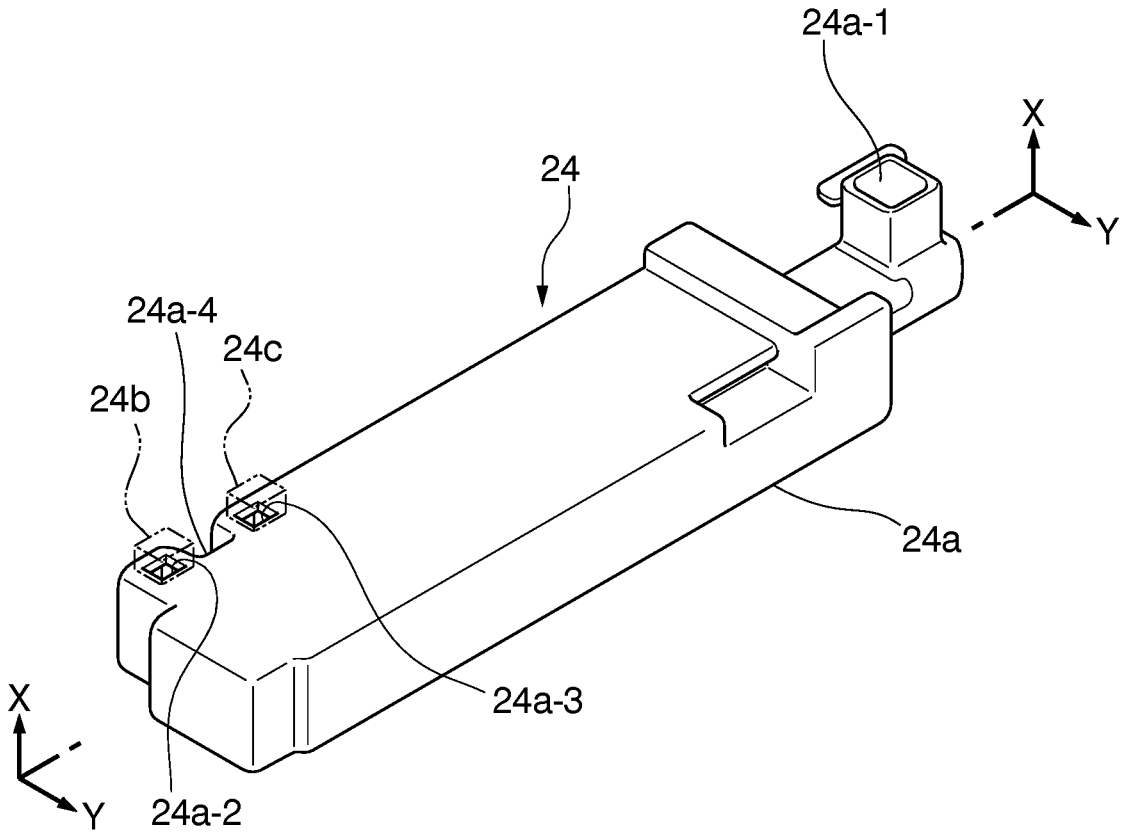
FIG. 2 is a perspective view illustrating a waste toner container 24 of the multifunctional machine A according to the embodiment of the invention.

Hereinafter, the waste toner container 24 will be described by referring to FIGS. 2, 3A, and 3B as well as FIG. 1. The waste toner container 24 is a container that stores the waste toner T conveyed by the conveyance mechanism, and is detachably attached to the conveyance mechanism. The space provided in the waste toner container 24 is a comparatively large space inside the multifunctional machine A, and is designed so that the waste toner container is easily attached or detached when a cover (not shown) of the multifunctional machine A is opened. As shown in FIGS. 1 to 3B, the waste toner container 24 includes a storage container 24*a*, a full detection sensor 24*b*, a near detection sensor 24*c*, and a conveyance portion 24*d*.

The storage container 24*a* is a substantially rectangular parallelepiped body that has a predetermined space therein and is made of a synthetic resin, and stores the waste toner T while being provided in the horizontal direction. The storage container 24*a* includes a storage port 24*a*-1 which receives the waste toner T thereinto, a full detection window 24*a*-2, a near detection window 24*a*-3, and a partition portion 24*a*-4. The storage port 24*a*-1 is provided at the upper surface close to one end in the length direction of the storage container 24*a*, and is connected to the conveyance mechanism. The storage container 24*a* receives the waste toner T conveyed by the conveyance mechanism from the storage port 24*a*-1. The full detection window 24*a*-2 is provided at a full position to which the full detection sensor 24*b* is attached and which is close to the end at the opposite side of the storage port 24*a*-1 in the upper surface of the storage container 24*a*. The full detection window 24*a*-2 is an opening which receives light emitted from the full detection sensor 24*b* into the storage container 24*a*. The near detection window 24*a*-3 is provided at a nearly full position to which the near detection sensor 24*c* is attached and which is closer to the storage port 24*a*-1 than the full detection window 24*a*-2 in the upper surface of the storage container 24*a*. The near detection window 24*a*-3 is an opening which receives light emitted from the near detection sensor 24*c* into the storage container 24*a*. The partition portion 24*a*-4 prevents the waste toner T that reaches the nearly full position from directly moving to the full position before the near detection sensor 24*c* has detected that the waste toner has reached the nearly full position. The partition portion 24*a*-4 is provided to disturb the movement of the waste toner T between the nearly full position and the full position inside of the storage container 24*a*.

The full detection sensor 24*b* is provided at the full position close to the end at the opposite side of the storage port 24*a*-1 along the length direction of the storage container 24*a*. The full detection sensor 24*b* detects whether the waste toner T reaches the full position which is the end of the storage container 24*a*, that is, the storage container 24*a* is fully filled with the waste toner. The full detection sensor 24*b* includes a light emitting element and a light receiving element which are disposed to face each other. The light emitting element emits light downward via the full detection window 24*a*-2. The light receiving element outputs a detection signal with the light emitted from the light emitting element to a CPU (not shown).

The near detection sensor 24*c* is provided at the near position which is closer to the storage port 24*a*-1 of the storage container 24*a* than the full detection sensor 24*b*, and includes a light emitting element and a light receiving element which are disposed to face each other. The near detection sensor 24*c* detects whether the waste toner T reaches the near full position which is closer to the storage port 24*a*-1 than the full position, that is, the storage container 24*a* is nearly fully filled with the waste toner. As in the case of the full detection sensor 24*b*, the light emitting element emits light downward via the near detection window 24*a*-3, and the light receiving element outputs a detection signal with the light from the light emitting element to a CPU.

Figure 3A:
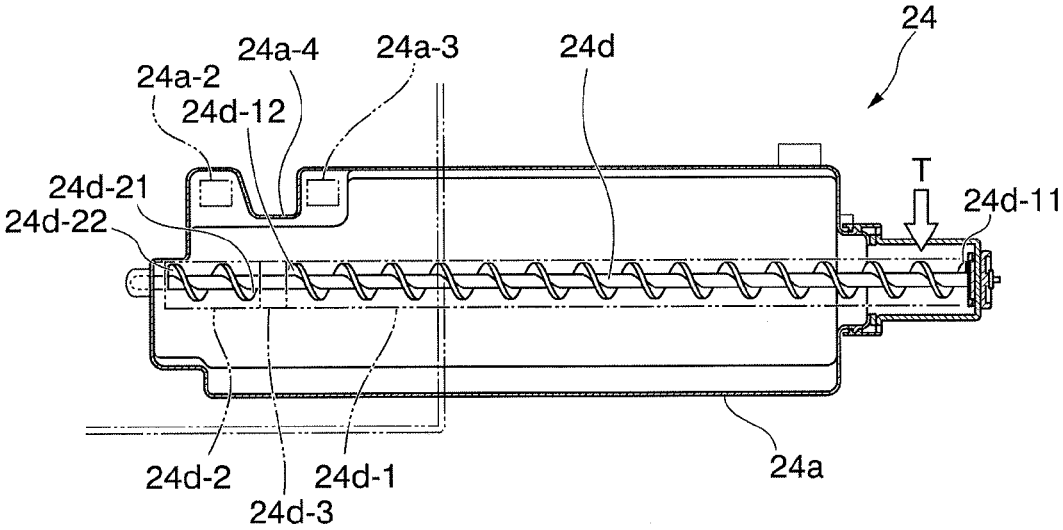
FIG. 3A is a cross-sectional view taken along the line X-X of the waste toner container 24 of the multifunctional machine A according to the embodiment of the invention.
Figure 3B:
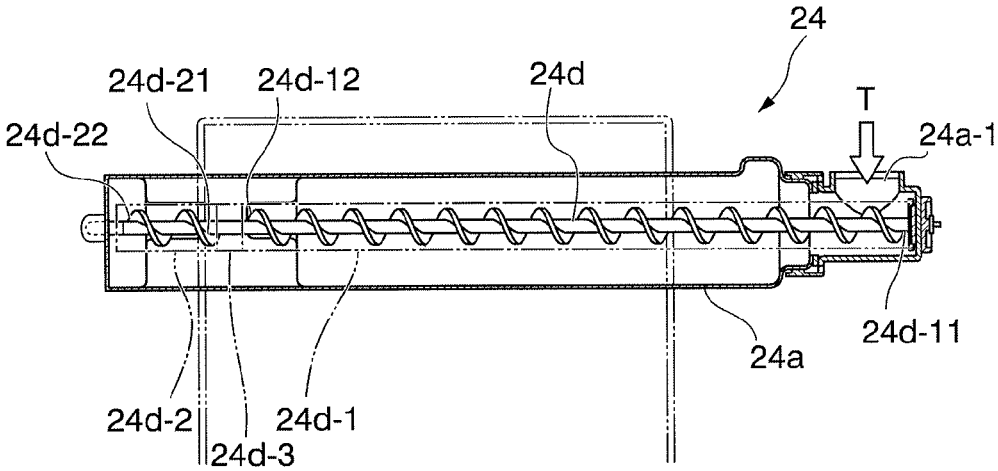
FIG. 3B is a cross-sectional view taken along the line Y-Y of the waste toner container 24 of the multifunctional machine A according to the embodiment of the invention.

As shown in FIGS. 3A and 3B, the conveyance portion 24*d* is a screw conveyor that extends from the storage port 24*a*-1 (refer to FIG. 2) to the opposite end thereof along the length direction of the storage container 24*a*. The conveyance portion 24*d* includes an axial rod which extends along the length direction of the storage container 24*a* from the storage port 24*a*-1 and a spiral protrusion which is formed on the circumferential surface thereof. The waste toner T is conveyed from the storage port 24*a*-1 along the length direction thereof in a manner such that the conveyance portion 24*d* rotates about the axial rod. The conveyance portion 24*d* includes a first spiral protrusion 24*d*-1, a second spiral protrusion 24*d*-2, and a third range 24*d*-3.

The first spiral protrusion 24*d*-1 has a range where the spiral protrusion is formed from the vicinity of the storage port 24*a*-1 to that of the nearly full position associated with the near detection sensor 24*c* (refer to FIG. 2). The first spiral protrusion 24*d*-1 conveys the waste toner T from the storage port 24*a*-1 to the near position.

The third range 24*d*-3 is provided between the first spiral protrusion 24*d*-1 and the second spiral protrusion 24*d*-2, and separates the first spiral protrusion 24*d*-1 and the second spiral protrusion 24*d*-2 from each other. Hereinafter, the end of the third range 24*d*-3 close to the first spiral protrusion 24*d*-1 is referred to as a starting point of the third range, and the end of the third range 24*d*-3 close to the second spiral protrusion 24*d*-2 is referred to as a end point of the third range.

The second spiral protrusion 24*d*-2 has a range where the spiral protrusion is provided from the end point of the third range to the vicinity of the full position where the full detection sensor 24*b* is located (refer to FIG. 2). The second spiral protrusion 24*d*-2 conveys the waste toner T which reaches the near position and then passes by the third range 24*d*-3 to the full position.

The third range 24*d*-3 is a range where the spiral protrusion is not provided between the first spiral protrusion 24*d*-1 and the second spiral protrusion 24*d*-2. The third range 24*d*-3 is used to make the waste toner T pass therethrough at a speed lower than the conveyance speed of the first spiral protrusion and the second spiral protrusion. Hereinafter, the end of the first spiral protrusion 24*d*-1 closer to the storage port 24*a*-1 is referred to as an end 24*d*-11, and the end at the opposite side of the first spiral protrusion 24*d*-1 further from the storage port 24*a*-1 is referred to as an end 24*d*-12.

Further, the end of the second spiral protrusion 24*d*-2 closer to the storage port 24*a*-1 is referred to as an end 24*d*-21, and the end at the opposite side of the second spiral protrusion 24*d*-2 further from the storage port 24*a*-1 is referred to as an end 24*d*-22.

The fixing unit 25 fixes the toner image transferred from the intermediate transfer unit 23 to the recording sheet onto the recording sheet by applying heat and pressure thereto. The fixing unit 25 is disposed at the conveyance path of the recording sheet. Further, the sheet feeding rollers 26 are respectively provided at the corresponding positions of the sheet feeding cassette 27 and the sheet feeding tray 28 on the lower side of the apparatus. By the sheet feeding rollers 26, the recording sheet is conveyed from the sheet feeding cassette 27 or the sheet feeding tray 28 to the intermediate transfer unit 23 as described above (specifically, between the driving roller 23*b* and the secondary transfer roller 23*f*).

Next, the operation of the multifunctional machine A according to the embodiment with the above-described configuration will be described by referring to FIGS. 4 and 5.

First, a user who wants to copy a document using the multifunctional machine A sets the document on the image reading device 1. Then, the user starts copying using the multifunctional machine A.

When the copying is started, the multifunctional machine A performs image forming using the image forming unit 21. The multifunctional machine A conveys the waste toner T generated during the image forming using the conveyance mechanism, and stores the waste toner T in the waste toner container 24 in which the conveyance portion 24*d* rotates.

Figure 4A:
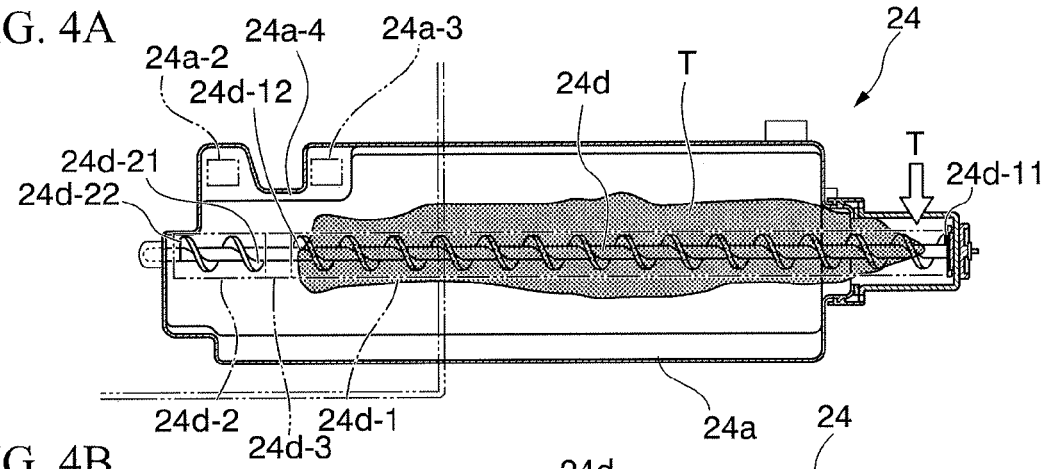
FIG. 4A is a cross-sectional view taken along the line X-X indicating the stream of waste toner in the waste toner container 24 of the multifunctional machine A according to the embodiment of the invention.
Figure 4B:
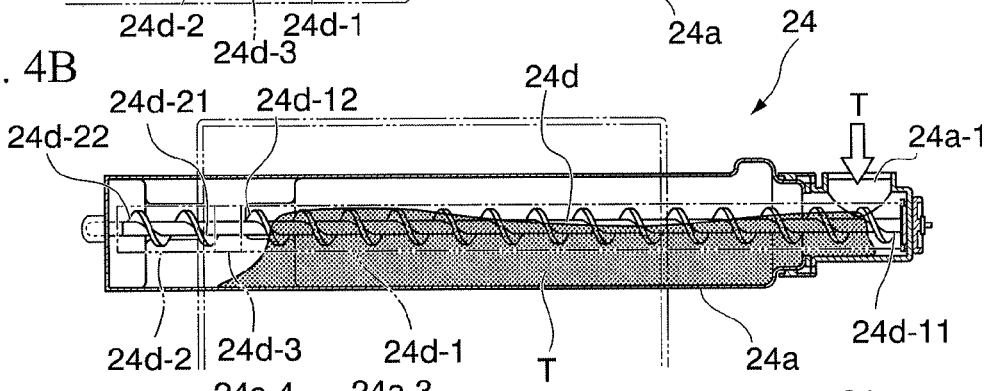
FIG. 4B is a cross-sectional view taken along the line Y-Y indicating the stream of the waste toner in the waste toner container 24 of the multifunctional machine A according to the embodiment of the invention.

After the waste toner T drops from the storage port 24*a*-1 into the waste toner container 24, the waste toner T is conveyed from the storage port 24*a*-1 toward the end 24*d*-12 of the first spiral protrusion 24*d*-1 by the conveyance portion 24*d* disposed right below the storage port 24*a*-1. Since the diameter of the circular cross-section of the conveyance portion 24*d*, which is perpendicular to the length direction of the conveyance portion 24*d*, is sufficiently smaller than the storage container 24*a*, the waste toner T present around the conveyance portion 24*d* is mainly conveyed. When this operation is continuously performed, the waste toner T reaches the end 24*d*-12 of the first spiral protrusion 24*d*-1 as shown in FIGS. 4A and 4B. At this time, the waste toner T is accumulated only around the conveyance portion 24*d*, and is not yet accumulated to be spread in the horizontal direction of the storage container 24*a*.

Figure 4C:
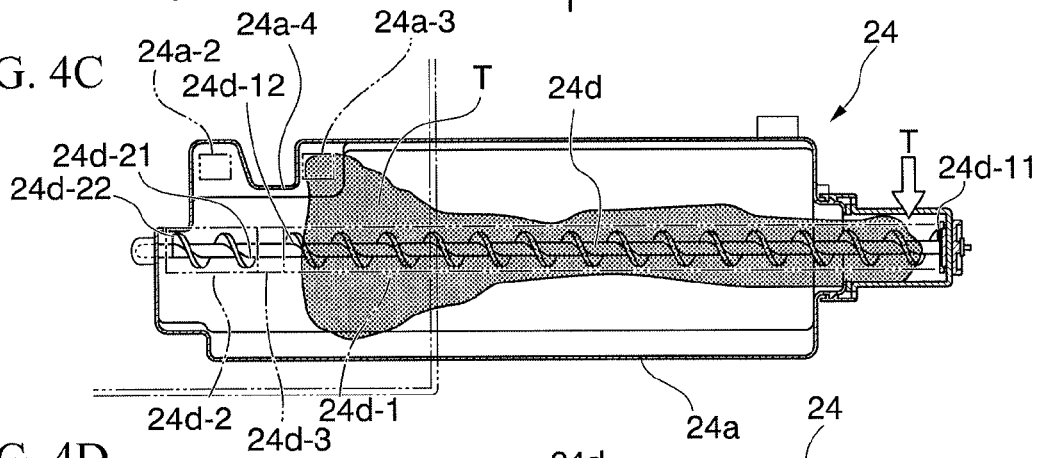
FIG. 4C is a cross-sectional view taken along the line X-X indicating the stream of the waste toner in the waste toner container 24 of the multifunctional machine A according to the embodiment of the invention.
Figure 4D:
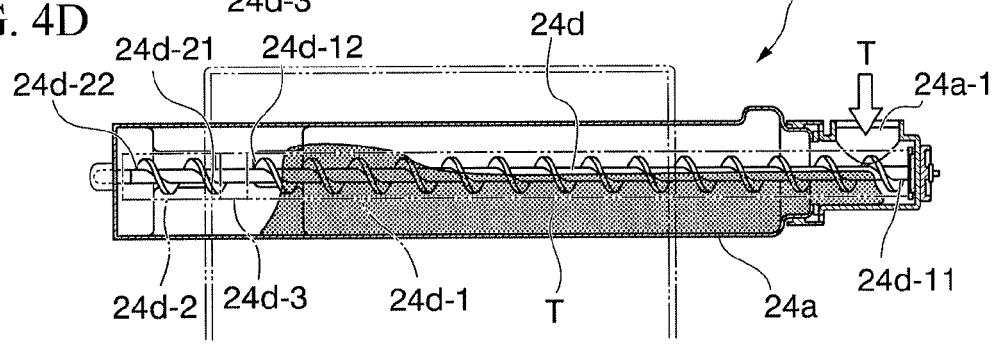
FIG. 4D is a cross-sectional view taken along the line Y-Y indicating the stream of the waste toner in the waste toner container 24 of the multifunctional machine A according to the embodiment of the invention.

The waste toner T is not actively conveyed to the third range 24*d*-3 after it reaches the end 24*d*-12 of the first spiral protrusion 24*d*-1 since the third range 24*d*-3 without the spiral protrusion is provided in front of the end 24*d*-12 along the running direction of the conveyance. When the waste toner T is continuously supplied from the storage port 24*a*-1, the waste toner T staying at the end 24*d*-12 is accumulated to be spread in the height direction and the width direction in a manner of repeatedly flowing and being deposited since the waste toner is suppressed from being conveyed to the third range. By this operation, as shown in FIGS. 4C and 4D, the waste toner T reaches the side surfaces close to the end 24*d*-11 and the end 24*d*-12. The near detection sensor 24*c* is attached onto the near detection window 24*a*-3 at the nearly full position close to the end 24*d*-12. Accordingly, when the waste toner T approaches the periphery of the nearly full position, the near detection sensor 24*c* detects the waste toner T. That is, it is detected that the waste toner T has reached a location just before the full detection sensor 24*b*. Therefore, the multifunctional machine A detects that the waste toner container 24 is in a state where it is not fully filled with the waste toner, but is nearly fully filled with the waste toner.

Furthermore, when the waste toner T is supplied from the storage port 24*a*-1, the waste toner T staying around the end 24*d*-12 of the first spiral protrusion 24*d*-1 is pressed by the waste toner T conveyed from behind, so that the waste toner T starts to be conveyed from the starting point of the third range to the end point of the third range. At this time, since the partition portion 24*a*-4 is provided between the nearly full position and the full position, the waste toner T cannot directly move from the nearly full position to the full position.

Figure 5A:
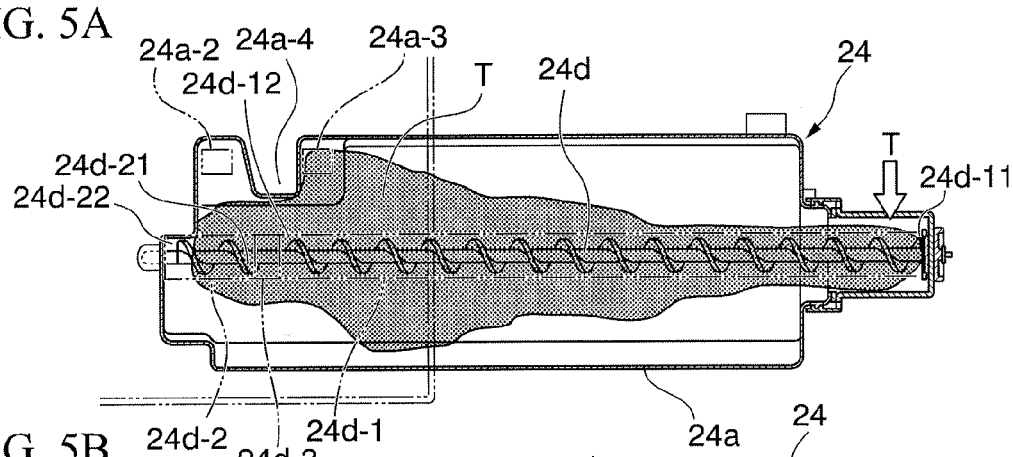
FIG. 5A is a cross-sectional view taken along the line X-X indicating the stream of the waste toner in the waste toner container 24 of the multifunctional machine A according to the embodiment of the invention.
Figure 5B:
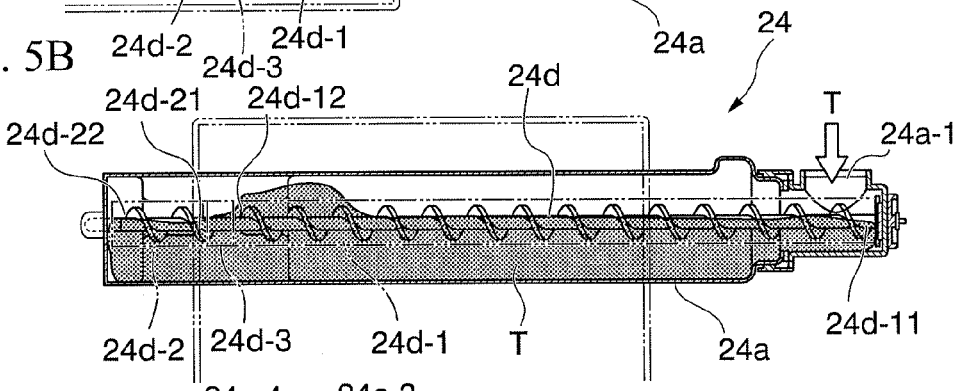
FIG. 5B is a cross-sectional view taken along the line Y-Y indicating the stream of the waste toner in the waste toner container 24 of the multifunctional machine A according to the embodiment of the invention.
Figure 5C:
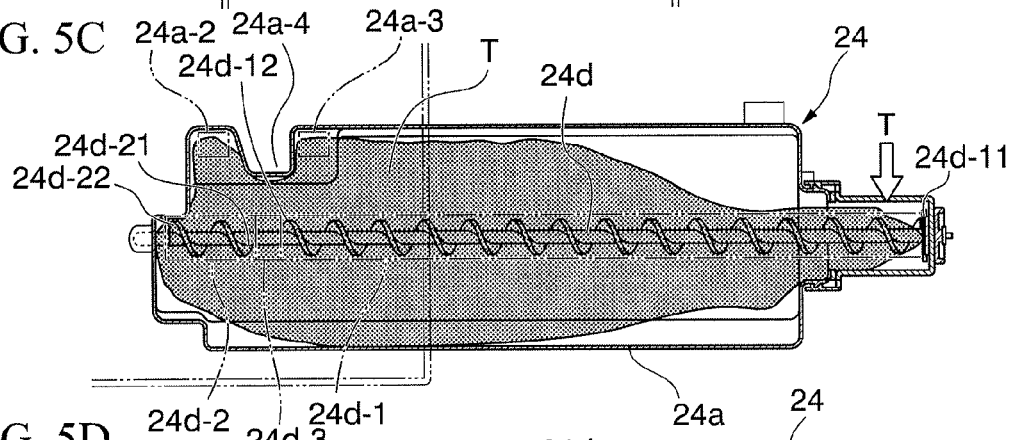
FIG. 5C is a cross-sectional view taken along the line X-X indicating the stream of the waste toner in the waste toner container 24 of the multifunctional machine A according to the embodiment of the invention.
Figure 5D:
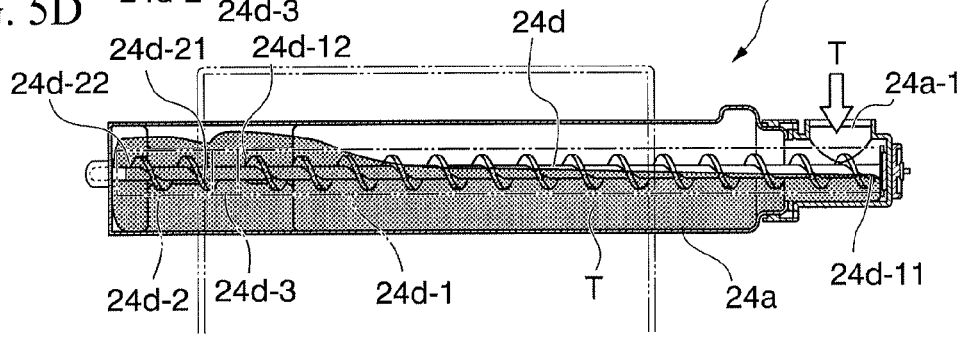
FIG. 5D is a cross-sectional view taken along the line Y-Y indicating the stream of the waste toner in the waste toner container 24 of the multifunctional machine A according to the embodiment of the invention.

When the waste toner T passes by the third range 24*d*-3 and reaches the end 24*d*-21 of the second spiral protrusion 24*d*-2 close to the storage port 24*a*-1, the conveyance of the waste toner T is promoted again by the second spiral protrusion 24*d*-2. Then, as shown in FIGS. 5A and 5B, the conveyance is stopped when the waste toner T reaches the end 24*d*-22 of the second spiral protrusion 24*d*-1. The waste toner T which cannot move anywhere is accumulated to be spread in the height direction and the width direction in a manner of repeatedly flowing and being deposited. The full detection sensor 24*b* is attached onto the full detection window 24*a*-2 at the full position close to the end 24*d*-22. Accordingly, as shown in FIGS. 5C and 5D, when the waste toner T approaches the periphery of the full position, the full detection sensor 24*b* detects the waste toner T. That is, it is detected that the waste toner T has reached the full position of the storage container 24*a*. Therefore, the multifunctional machine A detects that the waste toner container 24 is in a state where it is fully filled with the waste toner.

As described above, in the multifunctional machine A according to the embodiment, since the third range 24*d*-3 without the spiral protrusion is provided between the first spiral protrusion 24*d*-1 and the second spiral protrusion 24*d*-2, it takes a certain amount of time for the waste toner T to move to the position of the full detection sensor 24*b* after it reaches the position of the near detection sensor 24*c*. As a result, it is possible to prevent erroneous detection in which full detection occurs immediately after nearly full detection or full detection occurs before nearly full detection.

While the embodiment of the invention has been described, the invention is not limited to the above-described embodiment, but may be modified, for example, as below.

In the above-described embodiment, the axial rod is configured so that the third range 24*d*-3 is not provided with the spiral protrusion, but the invention is not limited thereto.

Figure 6A:
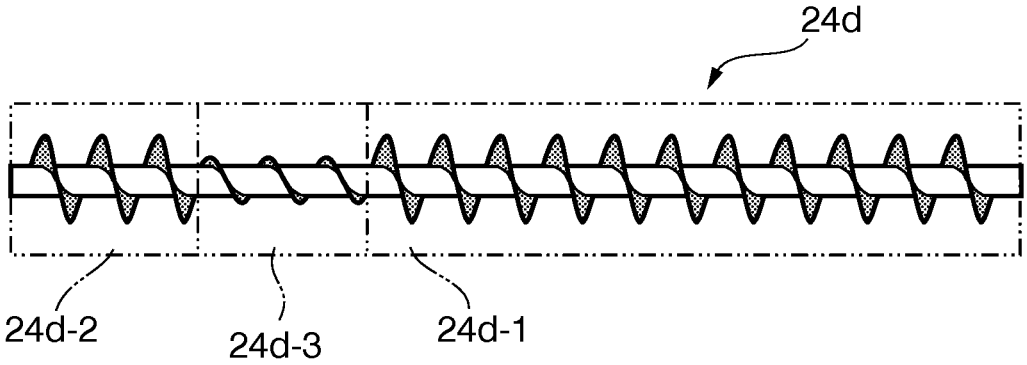
FIG. 6A is a schematic diagram illustrating a conveyance portion 24*d* of a multifunctional machine A according to a modified example of the embodiment of the invention.

For example, as shown in FIG. 6A, in the third range 24*d*-3, the height of the spiral protrusion in the direction perpendicular to the circumferential surface of the axial rod may be set to be smaller than the heights of the first spiral protrusion 24*d*-1 and the second spiral protrusion 24*d*-2. Therefore, the speed of conveying the waste toner T in the third range may be set to be lower than the speeds of conveyance of the first spiral protrusion 24*d*-1 and the second spiral protrusion 24*d*-2.

Figure 6B:
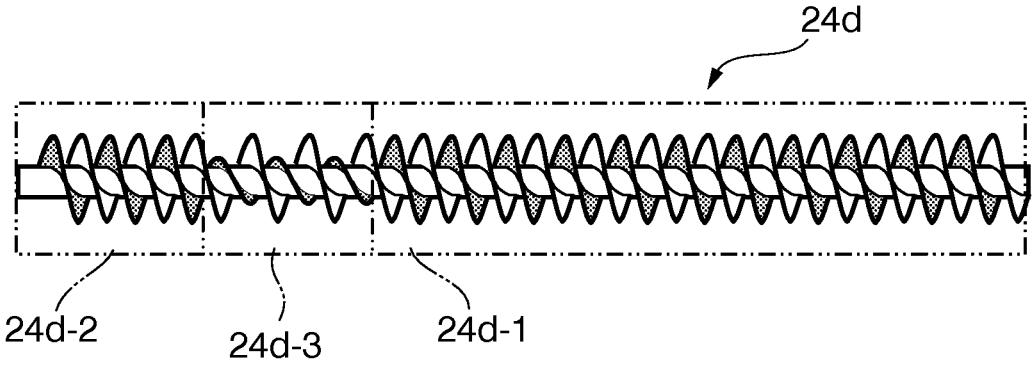
FIG. 6B is a schematic diagram illustrating a conveyance portion 24*d* of a multifunctional machine A according to another modified example of the embodiment of the invention.

Further, as shown in FIG. 6B, the first spiral protrusion 24*d*-1, the second spiral protrusion 24*d*-2, and the third range 24*d*-3 may be provided with a plurality of spiral protrusions disposed in parallel. In this case, in the third range 24*d*-3, the height of the spiral protrusion in the direction perpendicular to the circumferential surface of the axial rod in at least one of the plurality of spiral protrusions may be set to be smaller than those of the spiral protrusions of the first spiral protrusion 24*d*-1 and the second spiral protrusion 24*d*-2.

While preferred embodiments of the invention have been described and illustrated above, it should be understood that these are exemplary of the invention and are not to be considered as limiting. Additions, omissions, substitutions, and other modifications can be made without departing from the scope of the present invention. Accordingly, the invention is not to be considered as being limited by the foregoing description, and is only limited by the scope of the appended claims.

What is claimed is:

1. An image forming apparatus comprising:

a storage container which horizontally stores waste toner received from a storage port;

a full detection sensor which detects whether the waste toner has reached a full position in the storage container, the full position being at an end of the storage container at the opposite side from the storage port inside the storage container;

a near detection sensor which detects whether the waste toner has reached a nearly full position in the storage container closer to the storage port than the full position; and a conveyance portion which is provided inside the storage container, the conveyance portion including an axial rod, and the conveyance portion rotating about the axial rod, wherein the conveyance portion includes:

a first spiral protrusion which conveys the waste toner to the nearly full position;

a second spiral protrusion; and a third range which is provided between the first spiral protrusion and the second spiral protrusion and through which the waste toner passes at a speed lower than the conveyance speed of the first spiral protrusion and the second spiral protrusion, the second spiral protrusion conveying the waste toner from the third range to the full position, and wherein the storage container includes a partition portion which is provided between the nearly full position and the full position so as to separate therebetween and which disturbs the movement of the waste toner so as to prevent the waste toner that reaches the nearly full position from directly moving to the full position before the near detection sensor has detected that the waste toner has reached the nearly full position.

2. The image forming apparatus according to claim 1, wherein the third range is not provided with a spiral protrusion.

3. The image forming apparatus according to claim 1, wherein the third range is provided with a third spiral protrusion of which a height in the direction perpendicular to the circumferential surface of the axial rod is smaller than that of the first spiral protrusion.

4. The image forming apparatus according to claim 1, wherein a third spiral protrusion is formed in the third range, and each of the first spiral protrusion, the second spiral protrusion, and the third spiral protrusion is formed as a plurality of spiral protrusions formed in parallel to each other, and wherein in the third range, the height of at least one of the plurality of parallel spiral protrusions in the direction perpendicular to the circumferential surface of the axial rod is smaller than those of the first spiral protrusion and of the second spiral protrusion.

* * * * *